United States Patent [19]

Sawicki et al.

[11] Patent Number: 4,718,124

[45] Date of Patent: Jan. 12, 1988

[54] PATIENT GOWN

[76] Inventors: Marsha M. Sawicki, 2155 School Pl.; Eric C. Herb, 619 Devon Rd., both of Venice, Fla. 33595

[21] Appl. No.: 3,023

[22] Filed: Jan. 13, 1987

[51] Int. Cl.[4] ..... A41B 9/00

[52] U.S. Cl. ..... 2/114; 2/DIG. 6; 2/DIG. 7

[58] Field of Search ..... 2/114, DIG. 7, DIG. 6

[56] References Cited

U.S. PATENT DOCUMENTS

| | | | |
|---|---|---|---|
| 4,027,687 | 6/1977 | McGowan | 2/DIG. 6 |
| 4,055,855 | 11/1977 | Ragone et al. | 2/114 |
| 4,570,268 | 2/1986 | Freeman | 2/114 |

*Primary Examiner*—Werner H. Schroeder
*Assistant Examiner*—J. L. Olds
*Attorney, Agent, or Firm*—Hoffman, Wasson & Fallow

[57] ABSTRACT

A patient gown which is a practical, comfortable, and cost-effective means of clothing patients in the health care field. The patient gown comprises sleeves provided with slits running from the neck all the way to the patient's arms to allow for immediate access to the patient's upper chest area; a body portion with a slit running the entire length of the rear of the gown; both of said slits having a plurality of "T" configured hook and loop fasteners to allow for great ease in securing the gown to the patient as well as allowing for great ease in adjusting the size of the gown to accommodate various different size wearers, as well as casts and enlarged bandages. Additionally, the gown comprises a front pocket, which allows for placement of a telemetry or other type unit therein, with a slit in the back portion of the pocket to allow a hook up directly to the wearer's body. The gown is also equipped with a means to allow the wearer to carry a drainage type bag, at a location preventing any back flow of liquid to the bladder freeing the patient's or nurse's hands.

4 Claims, 9 Drawing Figures

10
12
13
14
15
16
17
18
20
22
24
26
28
30
32
33
34
35
36
37
3
4

PATIENT GOWN

FIELD OF THE INVENTION

The invention relates to a patient's gown, and more specifically, to a patient's gown designed with several unique features, which allows the gown to be worn with comfort and utility. The gown permits convenient access to the arms and chest of the wearer. A unique T-tab is provided to accomplish this feature. Additionally, the gown can support various medical apparatus required for continuous patient health care.

DESCRIPTION OF THE RELATED ART

The typical hospital gown in widespread usage consists essentially of a garment having a long body portion and wide baggy sleeves. The body portion usually contains a slit running its entire length and located at the wearer's back. The wide baggy sleeves employed are often one contiguous piece. In certain instances, the sleeves are provided with slits running from the neckline of the garment to the sleeve's end.

Fastening means employed by the typical hospital garment to close the slitted portions have been selected from the following: metal snaps, material ties, buttons and hook and loop type fasteners. The present fastening systems are cumbersome and pose great difficulty for a bed-ridden or disabled person to secure without the aid of a second party. Even patients in full control of all their faculties have great difficulty in securing the extant fastening systems on the rear slit of the body of the garment. Various attempts have been made to solve this problem, but none have met with much success.

U.S. Pat. No. 4,570,268, issued Feb. 18, 1986, describes a hospital garment with square hook and loop tape fasteners spaced vertically along the marginal edges of the body of the gown. The square spaced fasteners located at the rear of the gown pose enormous problems for a wearer to secure without assistance of a second party. Securing the fasteners becomes a "hit" or "miss" type affair for the wearer and at the times when a partial "hit" occurs, a less than secure fit is obtained. The fastening system disclosed also severely limits the size of each particular gown.

In a situation where buttons, ties, or metal snaps are utilized, the wearer encounters an almost impossible task to secure the closure.

Many other problems exist in the present fastening systems, notably the systems provide a gown which can fit one or two patient sizes only. No gown produced today has the feature of almost infinite sizability.

U.S. Pat. No. 3,824,625, issued July 23, 1974, makes an attempt to overcome the problem but falls way short. Disclosed is a wrap-around gown which makes use of a fastening means comprised of hook and loop tapes. The configuration of the mating members contemplates use by a practitioner, not a patient, in that a patient working alone would be physically unable to secure the device. The gown has the mating portions on the front of the gown along a horizontal strip and does not allow for vertical play in its design. The strip is provided primarily to accommodate the flap and is not intended to provide flexibility. A patient attempting to secure the device would run into a "hit" or "miss" type affair. The gown is a staff gown and is not intended for use by patients.

The slit portions located on the sleeves of a gown provide similar fastening problems for a disabled or bed-ridden wearer to secure alone. Sleeve-fastening systems also create problems in sizing, no allowance is made to fit people of all shapes and sizes. Shoulder fastening means employed by some of the gowns today can be viewed in U.S. Pat. Nos. 4,570,268 and 4,422,186.

The gowns of today do not provide or meet the need for a standard, washable, one size fits all, dignified, multi-purpose and faceted garment.

Many patients who wear patient gown require constant monitoring by various medical devices (i.e., telemetry units and bladder drainage bags). These devices which vary in size, are usually strapped to the patient, held in the patient's hand, or attached to a nearby stationary stand. The devices have been a constant source of aggravation to the patient in that they are difficult to immobilize and are cumbersome to wear. No suitable gown has provided a means to hold such devices in a convenient functional location.

The major focus of the new patient gown, as described and claimed by this application, is to overcome all the problems existing in the garments as disclosed above. Provided is a simple, adjustable, multi-featured, lightweight, X-rayable, and washable gown.

An object of the invention is to provide a patient gown with fastening means which enables a disabled or handicapped person to secure same without the need for assistance.

Another object of the invention is to provide a gown which is one-size and adjustable to fit wearers of varying sizes and shapes.

Another object of the invention is to provide a gown with means to allow various medical devices (i.e., telemetry units, drainage apparatus) to be worn comfortably, securely, and in a convenient location. Such means frees the hands of the wearer and prevents inadvertant movement damaging the device (i.e., bladder drainage bag).

The medical device rests in the unique pocket configuration and is immobilized therein preventing inadvertent disconnection of the device.

SUMMARY OF THE INVENTION

The above objects and other objects and advantages of the present invention are accomplished by providing a patient's gown having: means to allow a wearer to easily secure the back slit without resorting to "hit" or "miss" techniques; similar means to secure the sleeve portions of the garment; means to secure telemetry devices and other like medical devices in the gown itself, such means further comprising a passage to allow direct connection of the devices through the gown; means to hold bladder drainage bags at a remote location to ensure the proper operation of the device with privacy and dignity and in general all the features needed to allow any patient to be self-sufficient.

In particular, the fastening means which allow for securement of the rear opening and shoulder openings comprise hoop and loop type fasteners in a unique T-shaped configuration which allow adjustability in two dimensions and eliminate the "hit" or "miss" challenge which patients encounter.

In addition, the T-shaped configuration allows the gown to be sized differently at different spots on the same gown. If one shoulder of the wearer contains a cast, that area can be sized to accommodate the cast while the other shoulder remains sized for a castless fit.

Additionally, a strategically located expandable pocket means is provided which enables the wearer to insert therein a medical monitor or the like with the leads fitting through a slit on the interior of the gown, to allow for the wires connecting the leads to the device to pass through said slit. The slit allows the patient to be continuously monitored while the gown is being removed from the patient.

Also provided is a loop or button hole or hook-like means located below the wearer's waist on the interior of the body portion of the gown. The loop means functions to hold a bladder drainage bag or the like, at a height or level required to maintain flow without backflow and also to place the bag inside the gown to hide from clear view.

In addition to all of the above, the gown is provided with a scooped neckline for comfort and accommodation of various patient sizes.

DETAILED DESCRIPTION OF THE PREFERRED EMBODIMENT

Figures 1, 2, 3, 4:
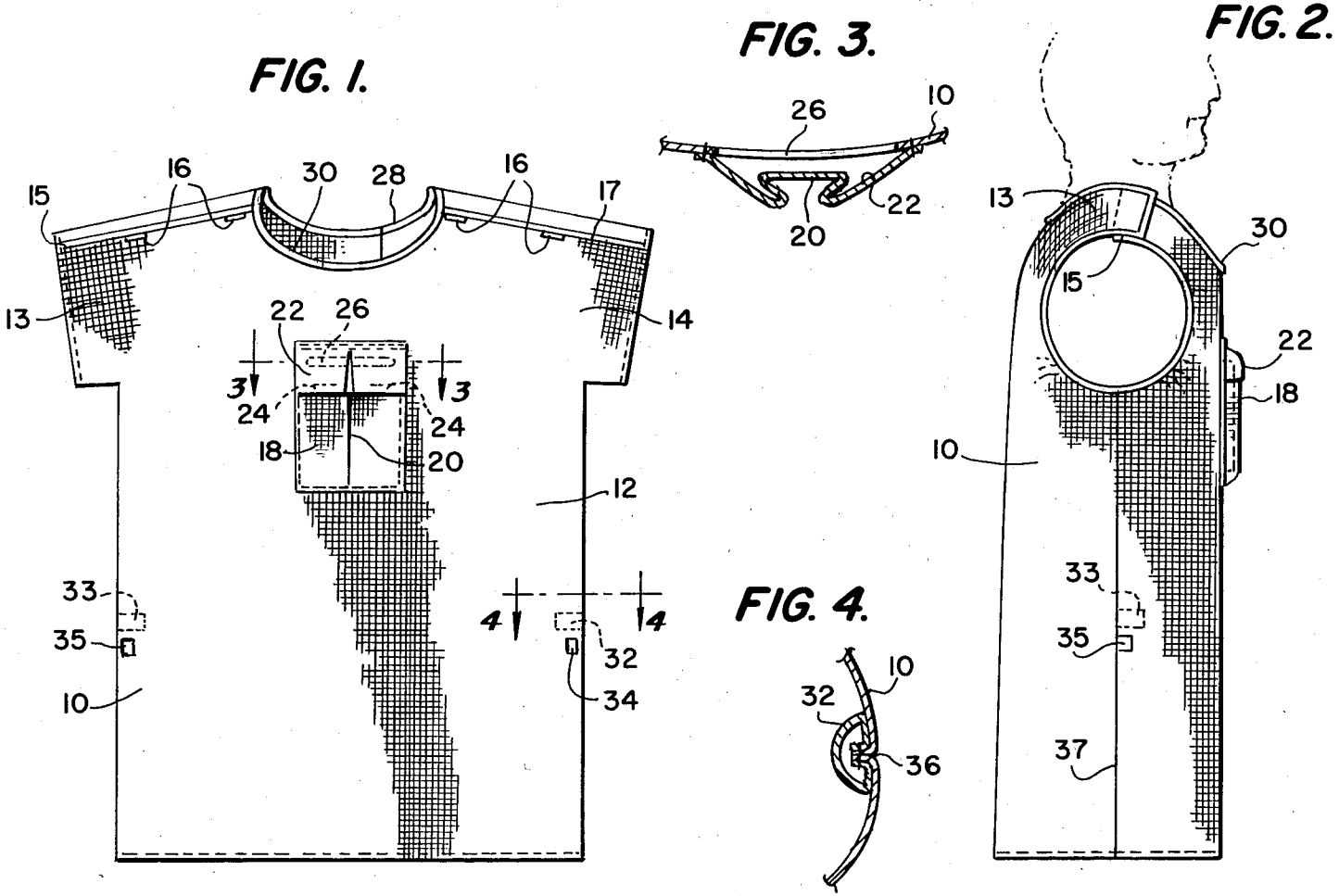
FIG. 1 is a front elevational view of the gown.
FIG. 2 is a side elevational view of the gown.
FIG. 3 is a cross-sectional view taken along line 3—3 of FIG. 1.
FIG. 4 is a horizontal cross-sectional view taken along line 4—4 of FIG. 1.

Referring to FIG. 1, there is shown a front elevational view of the patient gown in accordance with the preferred embodiment. The patient gown 10 is constructed of a main body portion 12, and sleeve portions 13 and 14 which are each provided with two adjustable T-shaped fasteners 16. The T-shaped fasteners are located along the finished slits 15 and 17 which run the entire length of the shoulder of the sleeve portions 13 and 14, respectively, to allow the opening and closing of the slit openings in an adjustable fashion. the fasteners are T-shaped hook and loop type mating portions.

In keeping with the invention, a pocket 18 is provided on the front panel of the gown 10 to accommodate various medical monitoring devices, such as telemetry units. The pocket 18 is provided with a pleat 20 to allow for expansion to accommodate various sized and shaped devices. In addition, the pocket 18 is provided with a flap 22 which overlaps the pocket and prevents a device inserted therein from falling out of the pocket. One embodiment places a closure 24 on the flap to securely seal the pocket and immobilize any device secured therein.

On the interior of the pocket 18, there is provided a slit 26 to accommodate the leads or any type of wiring which must run from the device to the patient. Such allows for constant monitoring of the patient as well as the ability to constantly monitor the patient during changing of the gown.

A scooped neckline 30 is provided to allow for greater patient comfort.

FIG. 2, which is a side-elevational view of the gown, better illustrates the exaggerated scooped neckline.

In addition, FIG. 2 better discloses the pocket 18 which is covered by the flap 22 to immobilize a medical device which can be inserted therein.

FIG. 3, which is a cross-section taken along the line 3—3 of FIG. 1, is a section taken along the slit 26 of the pocket. One can see that the flap 22 as well as the pocket is provided with a pleat 20 to allow for expansion to accommodate various sized devices securely.

Further to the invention there is provided a pair of loop means 32 and 33 (see FIGS. 1, 2 and 4), which is located on the lower portion of the gown along the seams 36 and 37. The loop means 32 and 33 are provided to allow one to hang a bladder drainage bag therefrom providing concealment and dignity to the patient. Additionally, the bag is located in a low enough location to prevent backflow out of the bag.

Also provided are two square holes 34 and 35 located in a similar location to that of the loop means 32 and 33, which act as an alternative location to hang the drainage bag device.

Figure 5:
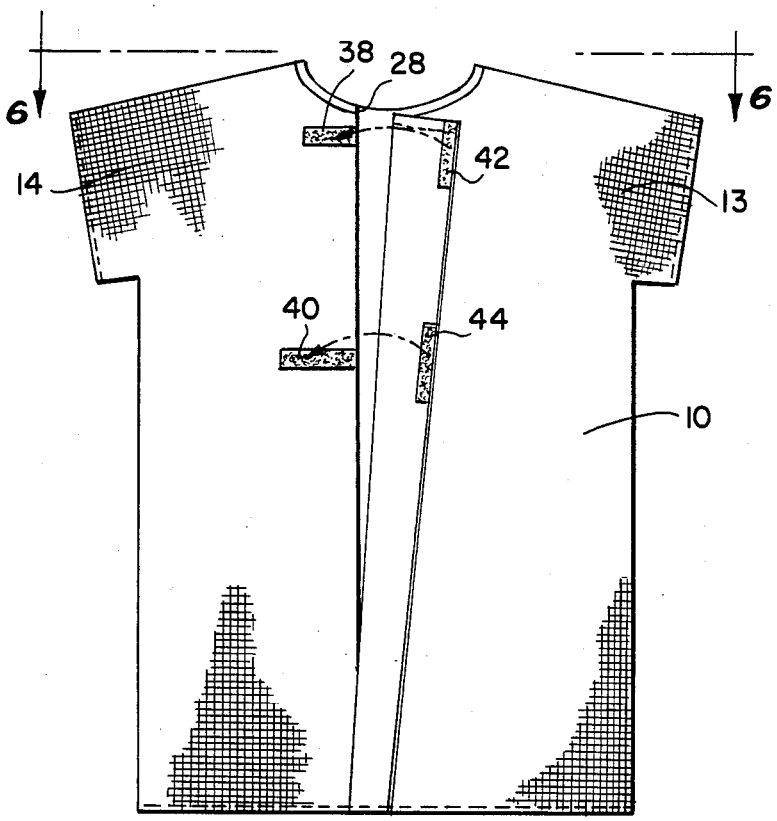
FIG. 5 is a rear elevational view with the rear panel folded back to expose the fastening means.

As can be seen from FIG. 1 and is better illustrated in FIG. 5, a rear slit 28 is provided to allow easy access for the patient into the gown.

The rear slit can be secured by the T-shaped adjustable fastening means 38, 40, 42 and 44. The fastening means comprise hook and loop type mating surfaces and are configured to allow the horizontal surface pads 38 and 40 to be mated to the vertical surface pads 42 and 44, respectively. The configuration of the pads allows for adjustability, as well as ease of securement, in that the "hit" or "miss" type configurations of the prior art are eliminated.

Figure 6:
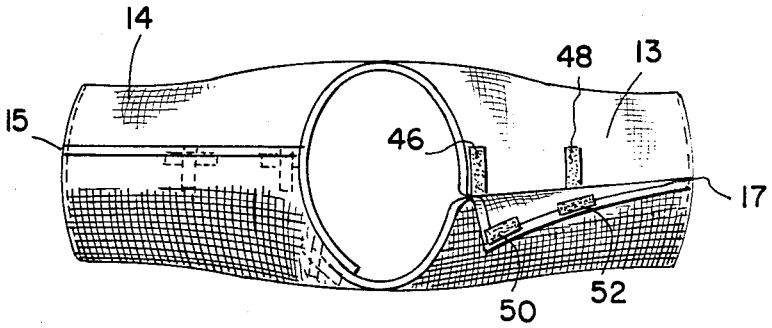
FIG. 6 is a top view with the sleeve folded back to show the fastening means.

FIG. 6 is a top view of the patient gown with sleeve portion 13 having its slit 17 folded back to illustrate the use of unique T-shaped mating pads 46, 48, 50 and 52 which allow for adjustability and ease of securement for the shoulders as well. The T-shaped fastening means allow a wearer to size sleeves 13 and 14 differently, to accommodate the necessity of a cast or the like on one of the shoulders.

Figure 7:
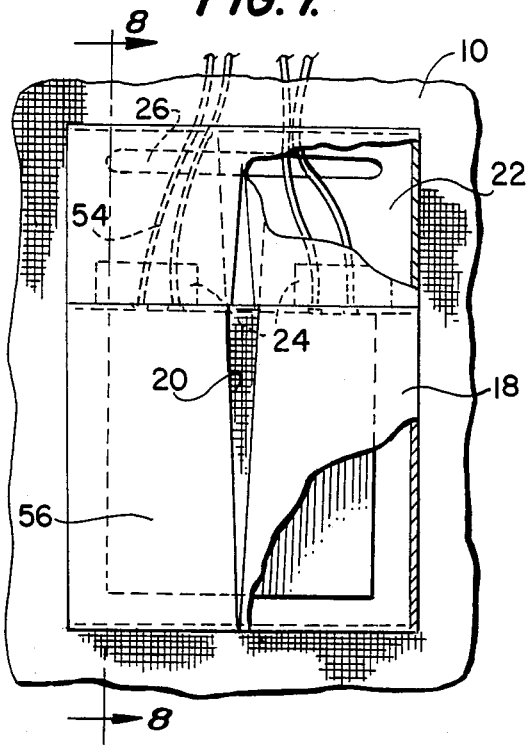
FIG. 7 is an enlarged front elevational view of the pocket.
Figure 8:
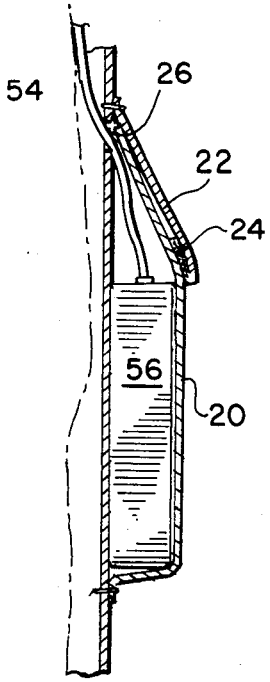
FIG. 8 is a vertical cross-sectional view taken along line 8—8 of FIG. 7.

FIGS. 7 and 8 are enlarged views of the unique pocket containing therein a telemetry unit 56. The pocket 18 makes use of a pleat 20 to allow for adjustability in its size as well as an overlapping flap 22 which securely holds a medical device 56 therein. In addition, one can provide additional fastening means 24 to secure the pleated flap 22 to the pocket 18. As illustrated, a telemetry unit 56 is contained with its wire leads 54 running through the slit 26 for engagement onto the patient. Such slit 26 also allows for the removal of the unit 56 during changing of the gown.

Figure 9:
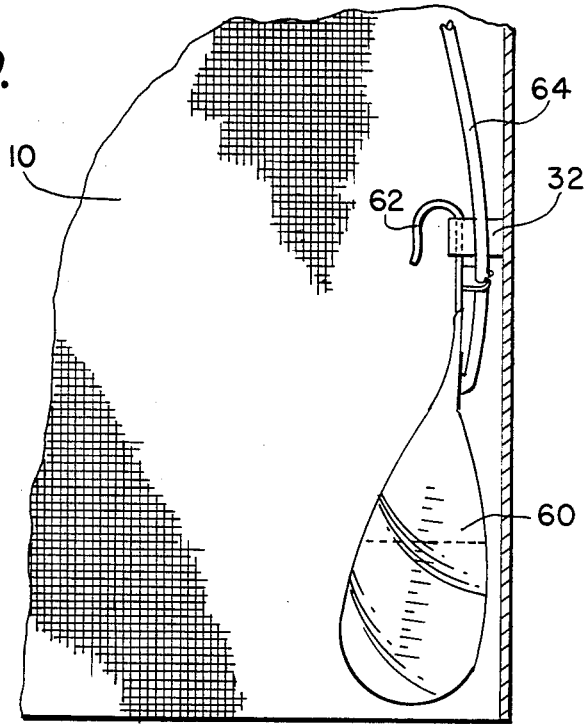
FIG. 9 is a fragmentary detail view of the bag suspension means.

FIG. 9 is an enlarged view of the loop means 32 holding a bladder drainage bag 60 by the hook 62 at a location to prevent back flow of the fluid into tube 64.

It is apparent that the gown described in detail above meets the specialized needs of patients. The gown gives the patient a high degree of comfort and dignity.

While preferred gowns have been disclosed and described, this invention is not limited to the particular details shown and described above, but that, in fact, alternative designs may be employed in the broader aspects of this invention.

What is claimed is:

1. A patient's gown, comprising (a) a body portion having two sleeves attached thereto, (b) said body portion comprising a front panel and first and second back panels connected by two seams, each panel having an interior side and an exterior side;

(c) said body portion and panels also defining a scooped neck opening;

(d) said sleeve portions having openings extending from the neck opening and along the arm so that access may be provided to the upper body of a patient without removing the gown;

(e) a first column of spaced apart hook and loop type mating fasteners having a length and a width; wherein said length of said fasteners being at least two times greater than said width of said fasteners;

(f) a set of said fasteners being mounted on the interior of one of said back panels vertically spaced apart with said length dimensions being aligned in said vertical direction while a second set of said fasteners being mounted on the exterior of the second of said back panels vertically spaced apart with said width dimensions being aligned in said vertical direction to allow for an adjustable overlapping T-type engagement of the fastening means;

(g) a second and a third set of fasteners being mounted on the openings in the sleeve portions having a spaced apart relationship, with said second set of fasteners being aligned with their width portions running along a marginal edge of the sleeve and a third set of fasteners being aligned with their length portions being along the other marginal edge of said sleeves to allow for a wide area for engagement of the fasteners; and (h) a pleated pocket located on said front panel of said body portion wherein a medical device can be housed.

2. A patient's gown as claimed in claim 1, wherein said pocket further comprises a slit-shaped opening in said front panel of said body portion behind said pocket whereby a medical device can be directly attached to said patient via interconnections.

3. A patient gown as claimed in claim 2, wherein said pocket further comprises a pleated flap overlapping said pleated pocket to allow for securement of said pleated pocket.

4. A patient's gown as claimed in claim 1, further comprising:

a loop means located at said seam between said interior sides of said front and said back panels at a height below said patient's waist whereby a drainage type bag can be hung therefrom preventing backflow from said drainage type bag.

* * * * *